US007733277B2

(12) United States Patent
Lin et al.

(10) Patent No.: US 7,733,277 B2
(45) Date of Patent: Jun. 8, 2010

(54) WIDE BAND ANTENNA

(75) Inventors: Ching-Chi Lin, Taipei Hsien (TW); Jia-Hung Su, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 364 days.

(21) Appl. No.: 11/782,224

(22) Filed: Jul. 24, 2007

(65) Prior Publication Data

US 2009/0027273 A1 Jan. 29, 2009

(51) Int. Cl.
*H01Q 1/24* (2006.01)
*H01Q 1/38* (2006.01)
*H01Q 19/10* (2006.01)

(52) U.S. Cl. ..... 343/702; 343/700 MS; 343/818

(58) Field of Classification Search ..... 343/700 MS, 343/702, 818, 846
See application file for complete search history.

(56) References Cited

U.S. PATENT DOCUMENTS 7,196,664 B2 * 3/2007 Asai ..... 343/700 MS
7,319,432 B2 * 1/2008 Andersson ..... 343/702
2005/0068234 A1 * 3/2005 Hung et al. ..... 343/702

FOREIGN PATENT DOCUMENTS

TW 095216657 9/2006

* cited by examiner

*Primary Examiner*—Shih-Chao Chen
(74) *Attorney, Agent, or Firm*—WPAT, P.C.; Anthony King

(57) ABSTRACT

A wide band antenna mounted to a dielectric element has a first patch, a second patch spaced from the first patch and a ground patch. The first patch has a first portion with a feeding point thereat and a second portion connecting the first portion. The second patch has a third portion and a fourth portion connecting the third portion. The first portion and the second portion of the first patch space from and parallel the third portion and the fourth portion of the second patch respectively. The ground patch is close to the first portion of the first patch and the third portion of the second patch. The first patch obtains a first frequency range. The second patch responses electromagnetic energy from the first patch to obtain a second frequency range. Scope of the first and the second frequency ranges covers portion of ultra wide band communication frequency.

5 Claims, 4 Drawing Sheets

WIDE BAND ANTENNA

BACKGROUND OF THE INVENTION

1. Field of the Invention

The invention relates to the field of antenna. More specifically, a wide band antenna is provided that has the characteristics of compact size, simple structure and easy fabrication and is particularly well-suited for operating at ultra wide band communication frequency range.

2. The Related Art

The ultra-wide band (UWB) communication is a wireless communication method, which was first developed by the United States Department of Defense in the 1960's and used for military purposes. The UWB communication has a wide frequency range (3.1 to 10.6 gigahertz), a low power consumption (−40 dBm/MHz), and a fast transmission speed. The UWB communication is expected to be used extensively in various systems, such as personal communication networks or home networks connecting personal computers (PC), television receivers (TV), personal digital assistants (PDA), digital versatile discs (DVD), digital cameras, and printers.

Due to advantages of the UWB communication, development of a wide band antenna with the characteristics of compact size, simple structure and easy fabrication is one of design project nowadays. Taiwan Patent Application Serial Number 095216657 is disclosed a wide band antenna. The wide band antenna has a radiating body and an impedance transfer arranged at one surface of a printed circuit board. The radiating body is consist of a funnel portion and a rectangle portion. The impedance transfer connects the funnel portion and a feeding cable. A ground portion is arranged at other surface of the printed circuit board.

The range of resonance frequency of the wide band antenna is tunable by changing dimension of the funnel portion of the radiating body. The impedance of the wide band antenna is tunable by adjusting impedance value of the impedance transfer. Tuning dimension of the funnel portion of the radiating body and impedance value of the impedance transfer to obtain preferred range of resonance frequency and impedance is complex for design process.

SUMMARY OF THE INVENTION

An object of the present invention is to provide a wide band antenna having a first patch, a second patch and a ground patch. The first patch has a first portion defining opposite sides, and a second portion connecting the first portion and defining opposite sides. The second patch within a feeding point has a third portion defining opposite sides and a fourth portion connecting the third portion and defining opposite sides. One side of the first portion and the second portion of the first patch respectively faces one side of the third portion and the fourth portion of the second patch. The ground patch is arranged close to the first portion of the first patch and the third portion of the second patch.

The first patch obtains an electrical resonance corresponding to a first frequency band. The second patch responses electromagnetic energy radiated from the first patch to obtain a second frequency range. Cooperation of the first patch and the second patch obtains a frequency covering the first frequency range and the second frequency range, which is contained in ultra wide band communication frequency band.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Structures of the wide band antenna described herein are sized and shaped to tune the wide band antenna for operation in ultra wide band communication frequency range. In an embodiment of the invention described in detail below, the wide band antenna has structure which is primarily associated with an operating frequency range included in ultra wide band communication frequency range. In the embodiment, operation frequency range of the wide band antenna is between 3.1 GHz and 4.7 GHz.

Figure 1:
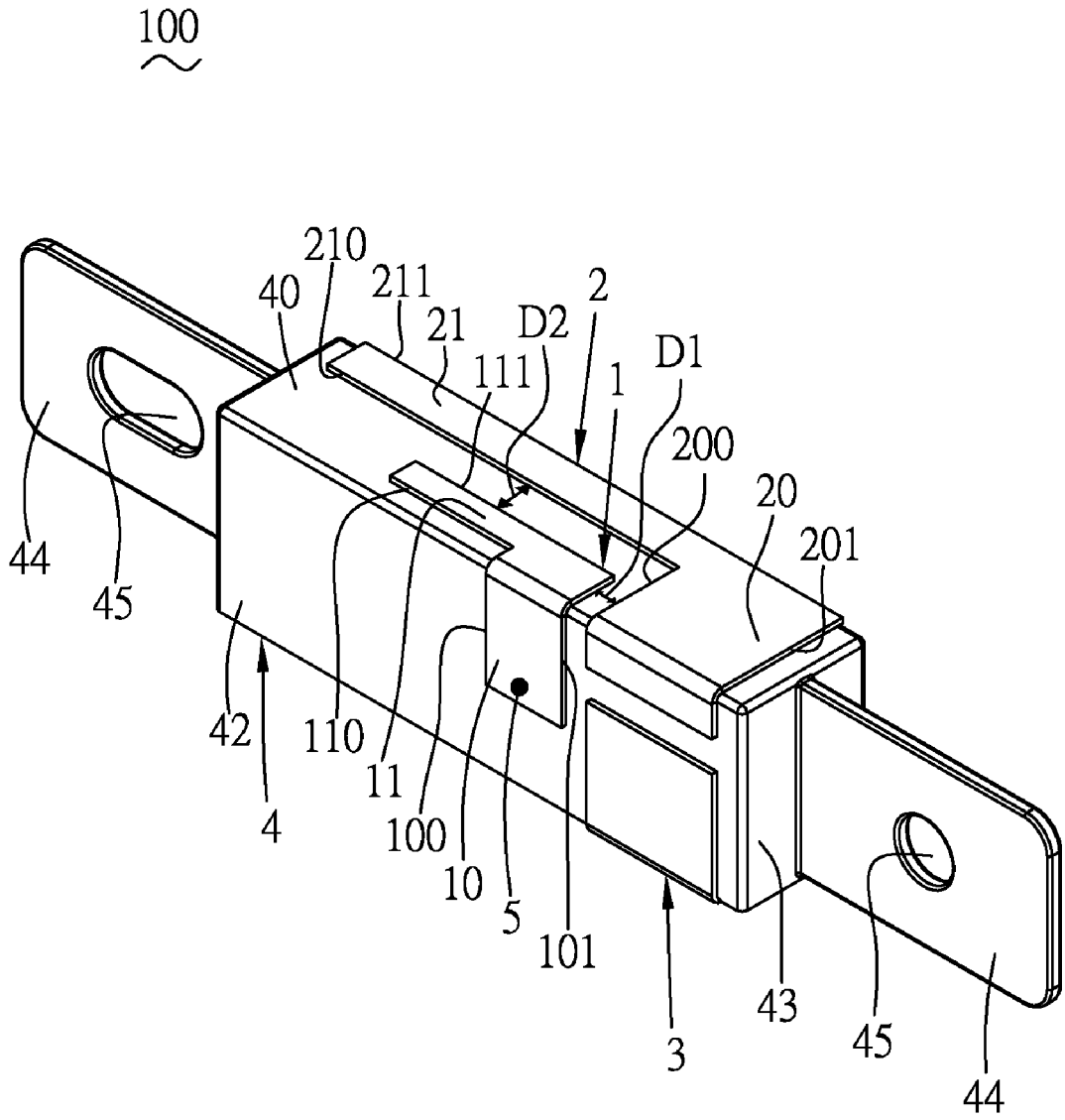
FIG. 1 is a front isometric view of a preferred embodiment of a wide band antenna according to the present invention.
Figure 2:
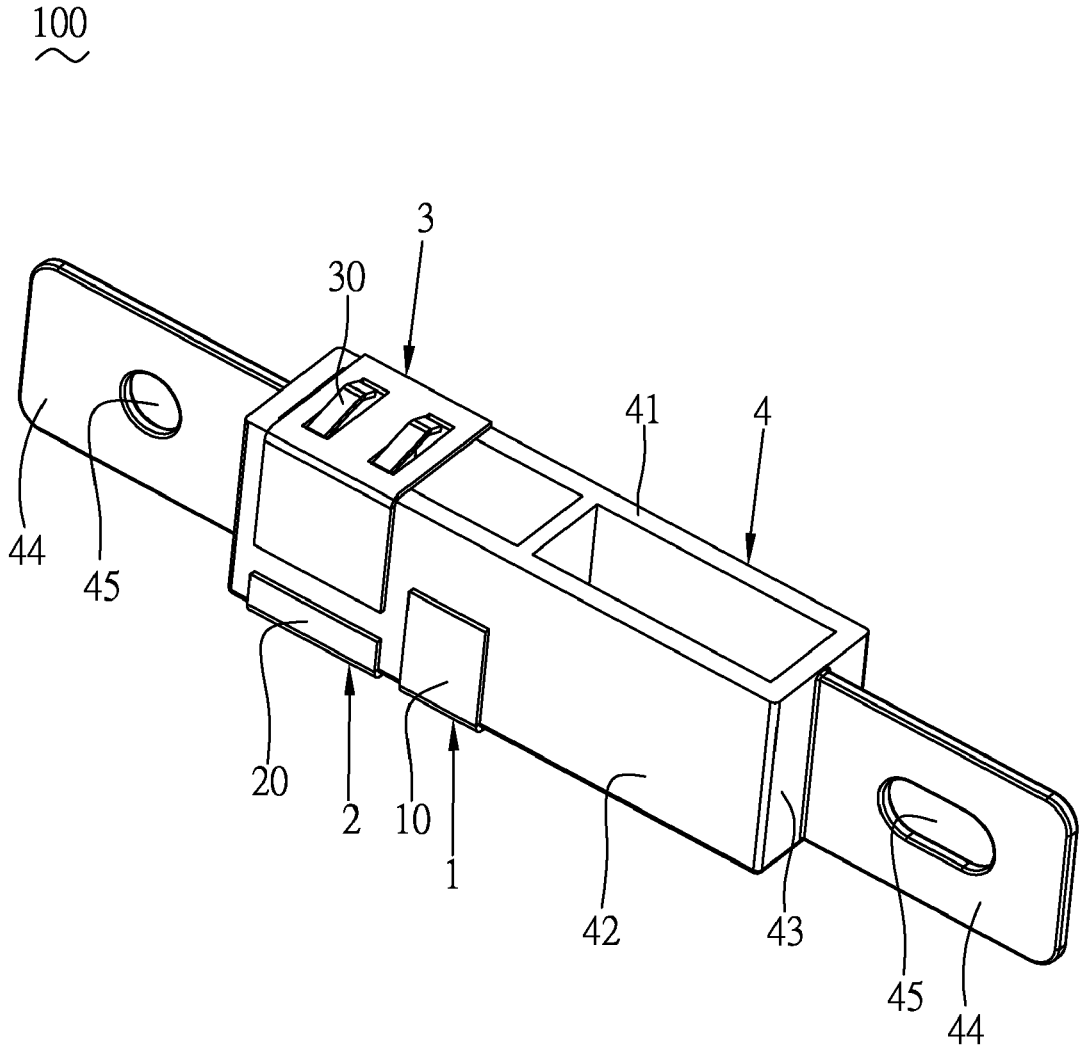
FIG. 2 is a bottom isometric view of the preferred embodiment of the wide band antenna according to the present invention.

Please refer to FIG. 1 and FIG. 2. A preferred embodiment of the wide band antenna 100 according to the present invention is shown. The wide band antenna 100 has a first patch 1, a second patch 2 and a ground patch 3 mounted to a dielectric element 4. The dielectric element 4 has a top surface 40, a bottom surface 41 opposite to the top surface 40, a front surface 42 connecting the top surface 40 and the bottom surface 41 and two opposite side surfaces 43 connecting the top surface 40, the bottom surface 41 and the front surface 42.

The first patch 1 and the second patch 2 are mounted to the top surface 40 and the front surface 42 of the dielectric element 4. The first patch 1 has a first portion 10 and a second portion 11 connecting the first portion 10. In this case, the first portion 10 is mounted to the top surface 40 and the front surface 42 of the dielectric element 4, and the second portion 11 is mounted to the top surface 40 of the dielectric element 4.

The first portion 10 defines a first side 100 and a second side 101 opposite to the first side 100. The second portion 11 also defines a third side 110 and a fourth side 111 opposite to the third side 110. In this embodiment, the first portion 10 and the second portion 11 form as L-shape. A feeding point 5 is arranged at the first portion 10 of the first patch 1.

The second patch 2 has a third portion 20 and a fourth portion 21 connecting the third portion 20. In this case, the third portion 20 is mounted to the top surface 40 and the front surface 42 of the dielectric element 4, and the fourth portion 21 is mounted to the top surface 40 of the dielectric element 4. The third portion 20 defines a fifth side 200 and a sixth side 201 opposite to the fifth side 200. The fourth portion 21 defines a seventh side 210 and an eighth side 211 opposite to the seventh side 210. In this embodiment, the third portion 20 and the fourth portion 21 also form as L-shape.

The first portion 10 of the first patch 1 is spaced from the third portion 20 of the second patch 2 to form a gap D1 therebetween. In this case, the second side 101 of the first portion 10 of the first patch 1 faces and parallels the fifth side 200 of the third portion 20 of the second patch 2. Also, the second portion 11 of the first patch 1 is spaced from the fourth portion 21 of the second patch 2 to form a gap D2 therebetween. In this embodiment, the fourth side 111 of the second portion 11 of the first patch 1 faces and parallels the seventh side 210 of the fourth portion 21 of the second patch 2.

The ground patch 3 is mounted to the bottom surface 41 and the front surface 42 of the dielectric element 4, which has an elastic contact 30. In this case, the ground patch 3 is arranged close to the first portion 10 of the first patch 1 and the third portion 20 of the second patch 2. The elastic contact 30 projects from portion of the ground patch 3 which is mounted to the bottom surface 41 of the dielectric element 4. The dielectric element 4 has a fixing plate 44 projecting from the opposite side surface 43 of the dielectric element 4 and a fixing bore 45 opened on the fixing plate 44.

Figure 3:
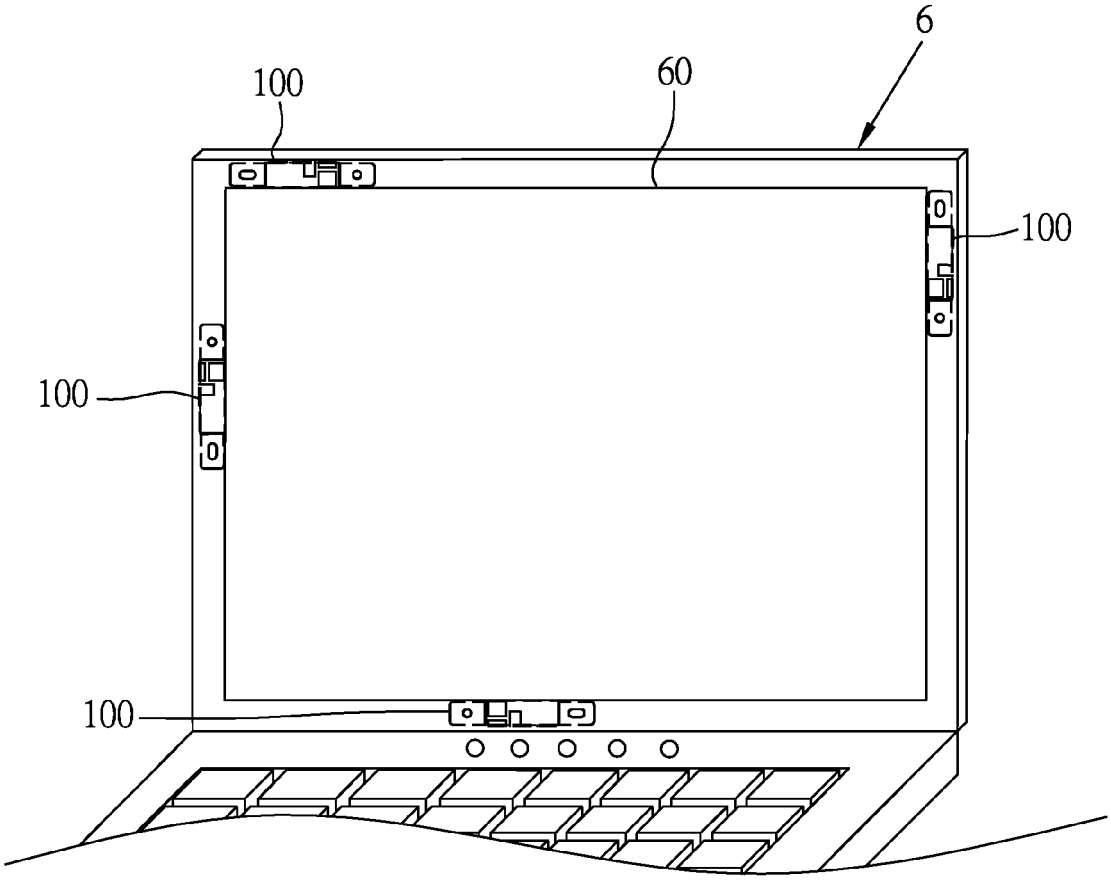
FIG. 3 is a front view of a display of a notebook incorporating the wide band antenna according to the present invention.

Please refer to FIG. 3. An electric device, especially a notebook 6 incorporates with the wide band antenna 100 via a fixing element (not shown in figures) matching and engaging with the fixing plate 44 and the fixing bore 45 of the dielectric element 4. In this embodiment, the wide band antenna 100 is mounted to the periphery of the display shielding 60 of the notebook 6, and the elastic contact 30 of the ground patch 3 electronically couples with the display shielding 60.

Please refer to FIG. 1 and FIG. 2. The first patch 1 of the wide band antenna 100 is associated primarily with a first frequency range in which the wide band antenna 100 operates. The size, the shape and the length of the first patch 1 have a most pronounced effect on antenna operating characteristics in the first frequency band as well as antenna gain and coving range of the first frequency band.

The second patch 2 responses electromagnetic energy radiated from the first patch 1 to obtain a second frequency range. The second patch 2 of the wide band antenna 100 is associated primarily with the second frequency range in which the wide band antenna 100 operates. Also, the size, the shape and the length of the second patch 2 have a most pronounced effect on antenna operating characteristics in the second frequency band as well as antenna gain and coving range of the second frequency band.

The gap D1 and the gap D2 between the first patch 1 and the second patch 2 are tunable for tuning antenna gain and covering range of the first frequency range and the second frequency range. In this case, the first patch 1 of the wide band antenna 100 obtains an electrical resonance corresponding to a quarter wavelength corresponding to 3.7 GHz. The second patch 2 of the wide band antenna 100 responses electromagnetic energy from the first patch 1 to obtain an electrical resonance corresponding to a half wavelength corresponding to 4.2 GHz.

Cooperation of the first patch 1 and the second patch 2 sets the shift of the first frequency range towards the lower frequency range. In this case, cooperation of the first patch 1 and the second patch 2 obtains the first frequency range and the second frequency range between 3.1 GHz and 4.7 GHz. Tuning of the gap D1 and the gap D2 between the first patch 1 and the second patch 2 sets the shift and antenna gain of the first frequency range and the second frequency range.

Figure 4:
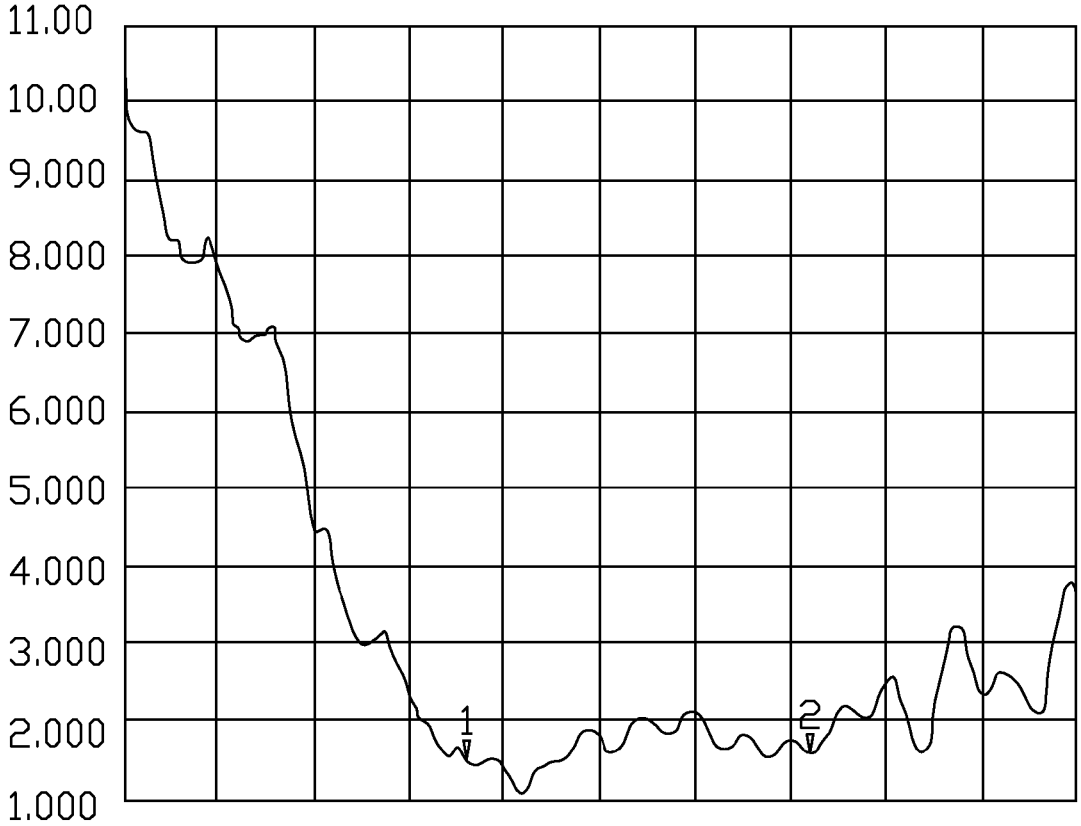
FIG. 4 shows a Voltage Standing Wave Ratio (VSWR) test chart of the wide band antenna.

Please refer to FIG. 4, which shows a Voltage Standing Wave Ratio (VSWR) test chart of the wide band antenna 100. When the wide band antenna 100 operates at frequency range between 3.1 GHz and 4.7 GHz, the VSWR value is below 2. Therefore, the wide band antenna 100 has compact size, simple structure and easily fabrication and is particularly well-suited for operating at ultra wide band communication frequency range.

Furthermore, the present invention is not limited to the embodiments described above; various additions, alterations and the like may be made within the scope of the present invention by a person skilled in the art. For example, respective embodiments may be appropriately combined.

What is claimed is:

1. A wide band antenna, comprising:

a first patch having a first portion and a second portion connected to said first portion, said first portion and said second portion respectively defining opposite sides;

a second patch having a third portion and a fourth portion connected to said third portion, said third portion and said fourth portion respectively defining opposite sides;

a ground patch arranged close to said first portion of said first patch and said third portion of said second patch; and a feeding point arranged at said first portion of said first patch, wherein one side of said first portion of said first patch faces one side of said third portion of said second patch to form a gap therebetween, and one side of said second portion of said first patch faces one side of said fourth portion of said second patch to form a gap there between;

wherein said wide band antenna is mounted to a dielectric element having a top surface, a bottom surface opposite to said top surface, a front surface connected to said top surface and said bottom surface, opposite side surfaces connected to said top surface, said bottom surface and said front surface, said first patch and said second patch mounted to said top surface and said front surface, said ground patch mounted to said bottom surface and said front surface;

wherein said dielectric element has a fixing plate projected from said side surfaces and at least a fixing bore opened on said fixing plate; and wherein said ground patch has at least an elastic contact, said elastic contact projected from portion of said ground patch which is mounted to said bottom surface of said dielectric element.

2. The wide band antenna as claimed in claim 1, wherein said wide band antenna is mounted to the periphery of a display shielding of a notebook, said elastic contact of said ground patch electronically coupled with said display shielding of said notebook.

3. The wide band antenna as claimed in claim 1, wherein said first patch and said second patch form as L-shape.

4. The wide band antenna as claimed in claim 1, wherein the gap between said first portion of said first patch and said third portion of said second patch is tunable for tuning operation frequency range of said wide band antenna.

5. The wide band antenna as claimed in claim 1, wherein the gap between said second portion of said first patch and said fourth portion of said second patch is tunable for tuning operation frequency range of said wide band antenna.

* * * * *